US010260271B2

(12) United States Patent
Possato et al.

(10) Patent No.: US 10,260,271 B2
(45) Date of Patent: Apr. 16, 2019

(54) SAFE

(71) Applicant: NCR Corporation, Duluth, GA (US)

(72) Inventors: Laerte Gualdia Possato, Sao Paulo (BR); Wilson Kume, Sao Paulo (BR); Joao Paulo de Oliveira, Franco da Rocho (BR); Marcel Canavesi Polo, Santo Andre (BR)

(73) Assignee: NCR Corporation, Atlanta, GA (US)

( * ) Notice: Subject to any disclaimer, the term of this patent is extended or adjusted under 35 U.S.C. 154(b) by 117 days.

(21) Appl. No.: 14/862,922

(22) Filed: Sep. 23, 2015

(65) Prior Publication Data

US 2017/0081901 A1 Mar. 23, 2017

(51) Int. Cl.

| | |
|---|---|
| ***E05G 1/024*** | (2006.01) |
| ***E05G 1/026*** | (2006.01) |
| ***E05G 1/06*** | (2006.01) |

(52) U.S. Cl.

CPC ..... *E05G 1/024* (2013.01); *E05G 1/026* (2013.01); *E05G 1/06* (2013.01)

(58) Field of Classification Search

CPC ..... E05G 1/024; E05G 1/026; E05G 1/06; F25D 23/067; F25D 23/00; A47B 51/00; A47B 88/43; A47B 96/02; A47B 47/00; A47B 47/03; A47B 46/005; A47B 46/00; A47B 57/10; A47B 88/40; A47B 88/407; A47B 96/021; A47B 96/067; A47B 96/00

USPC ... 109/26, 27, 49.5, 58–63.5, 78–85, 1 S, 74

See application file for complete search history.

(56) References Cited

U.S. PATENT DOCUMENTS

| | | | | | |
|---|---|---|---|---|---|
| 559,112 | A * | 4/1896 | Treman | E06B 5/12 | 109/1 V |
| 1,026,207 | A * | 5/1912 | Johnson | E06B 5/12 | 109/27 |
| 1,029,996 | A * | 6/1912 | Howard | A62C 3/00 | 109/26 |
| 1,120,435 | A * | 12/1914 | Benham | E06B 5/12 | 109/27 |
| 1,162,631 | A * | 11/1915 | Martin | E06B 5/12 | 109/27 |
| 1,164,488 | A * | 12/1915 | Fink | E05B 65/0082 | 109/27 |

(Continued)

FOREIGN PATENT DOCUMENTS

| | | | | |
|---|---|---|---|---|
| CA | 2792374 A1 * | 9/2011 | ..... | E05G 1/00 |
| CA | 2901698 A1 * | 8/2014 | ..... | G06F 19/205 |

(Continued)

*Primary Examiner* — Suzanne L Barrett
(74) *Attorney, Agent, or Firm* — Schwegman, Lundberg & Woessner

(57) ABSTRACT

A safe may include a body. The body may include a first sidewall, a second sidewall, a top, a bottom, a rear sidewall and a door that may define an interior volume. The door may be hingably connected to the second sidewall. The safe may also include a first side channel and a second side channel. The first side channel may be attached to the first sidewall and the second side channel may be attached to the second sidewall. The safe may also include a segmentation plate that may include a first vertical side rail and a second vertical side rail. The first vertical side rail may be slideably located in the first side channel and the second vertical side rail may be slideably located in the second side channel.

17 Claims, 6 Drawing Sheets

(56) References Cited

U.S. PATENT DOCUMENTS 1,715,480 A * 6/1929 Van Rossum ..... E05G 1/024 109/27
2,358,143 A * 9/1944 Castor ..... E06B 5/12 109/1 S
4,178,859 A * 12/1979 Seiz ..... E05G 1/024 109/27
4,347,796 A * 9/1982 King ..... F42D 5/045 109/49.5
5,060,582 A * 10/1991 Salzer ..... E06B 5/10 109/49.5
5,216,965 A * 6/1993 Liptak ..... F42B 39/20 109/27
5,563,364 A * 10/1996 Alhamad ..... A62C 2/06 102/303
7,000,550 B1 * 2/2006 Mandall ..... E06B 9/00 109/1 S
8,424,473 B1 * 4/2013 Mandall ..... F41H 5/226 109/26
8,939,358 B2 * 1/2015 Cardinal ..... E05G 1/00 235/379
9,212,848 B2 * 12/2015 Kendall ..... F25D 27/00
2009/0126606 A1 * 5/2009 Flood ..... E05G 1/024 109/27
2010/0218708 A1 * 9/2010 Carr ..... E04G 23/0218 109/83
2011/0113991 A1 * 5/2011 Boyes ..... E05G 1/026 109/23
2012/0186086 A1 * 7/2012 Tavares De Pinho ..... E05G 1/024 29/897.34
2012/0192769 A1 * 8/2012 Chiang ..... E05G 1/024 109/64
2014/0261110 A1 * 9/2014 Romero ..... E05G 1/026 109/64
2016/0135325 A1 * 5/2016 Chen ..... A47B 96/067 312/334.1

FOREIGN PATENT DOCUMENTS

GB 1022377 A * 3/1966 ..... A47B 57/404
WO WO 2011014116 A1 * 2/2011 ..... E05G 1/026
WO WO 2011152581 A1 * 12/2011 ..... E05G 1/026
WO WO 2014127384 A1 * 8/2014 ..... G07F 19/205

* cited by examiner

SAFE

BACKGROUND

Safes are a type of secure enclosure that are used in different industries. One use of a safe is in self-service terminals (SSTs), such as automated teller machines (ATMs). ATMs may contain large amounts of currency. To safeguard the currency, SSTs typically have a safe. However, SST safes face challenges that are not faced by ordinary safes. In particular, SST safes must include a number of relatively large apertures to allow valuable media to be transported out of the safe during a transaction. These relatively large apertures provide access to thieves. In an attempt to steal the currency, thieves may attack the safe using a variety of methods. For example, thieves may use tools to try to pry the door of the safe open. In addition, thieves may try to cut into a safe or use an explosive to try to blow the safe apart.

SUMMARY

A safe may include a body. The body may include a first sidewall, a second sidewall, a top, a bottom, a rear sidewall, and a door that may define an interior volume. The door may be hingably connected to the second sidewall. The safe may also include a first side channel and a second side channel. The first side channel may be attached to the first sidewall and the second side channel may be attached to the second sidewall. The safe may also include a segmentation plate that may include a first vertical side rail and a second vertical side rail. The first vertical side rail may be slideably located in the first side channel and the second vertical side rail may be slideably located in the second side channel.

BRIEF DESCRIPTION OF THE FIGURES

The above-mentioned and other features and advantages of embodiments disclosed herein, and the manner of attaining them, will become more apparent and the disclosure itself will be better understood by reference to the following description of example embodiments taken in conjunction with the accompanying drawings, wherein.

Corresponding reference characters indicate corresponding parts throughout the several views. The examples set out herein illustrate example embodiments, and such examples are not to be construed as limiting the scope of the disclosure any manner.

DETAILED DESCRIPTION

Figure 1:
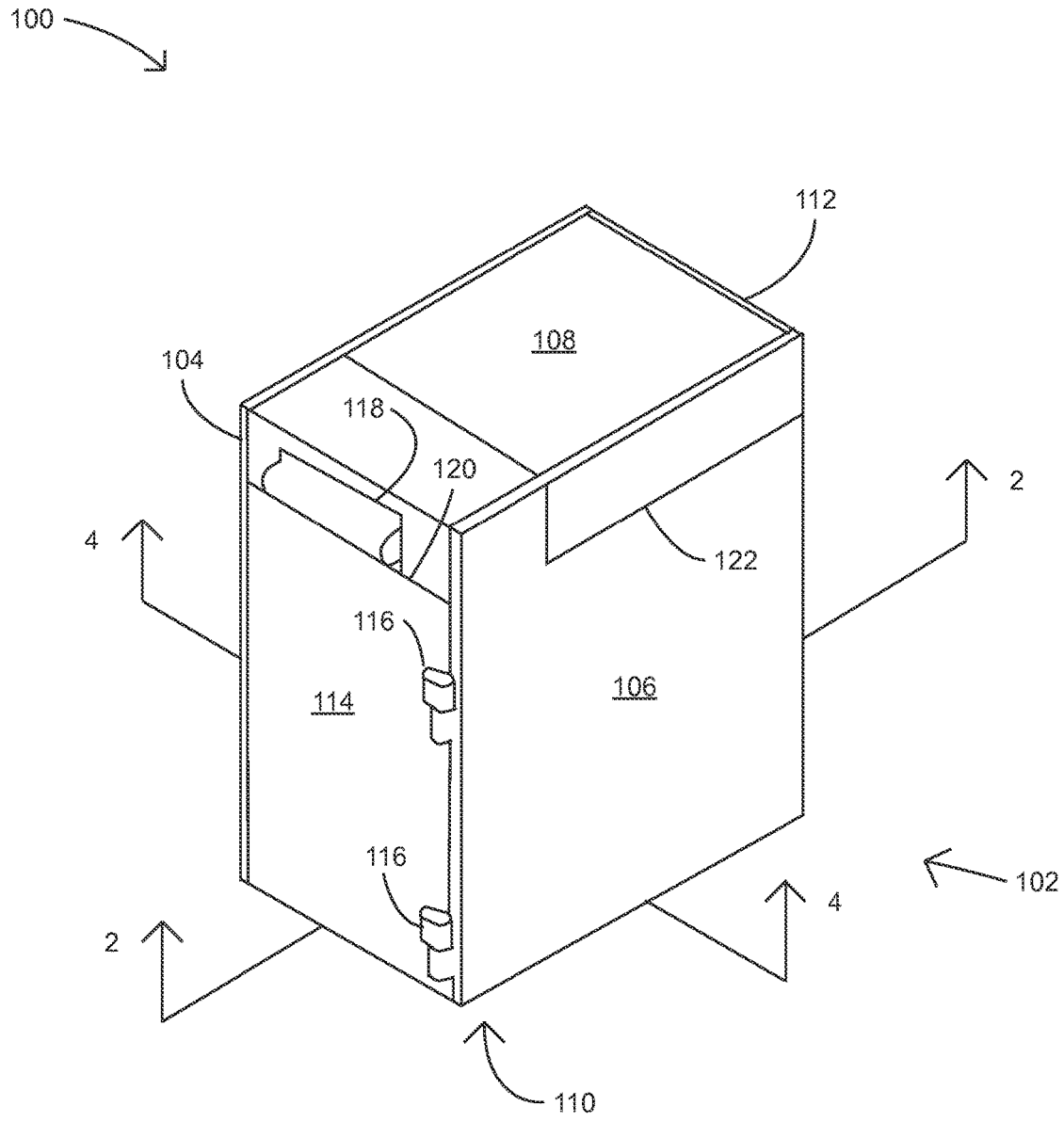
FIG. 1 shows an example safe consistent with embodiments disclosed herein.

The following detailed description refers to the accompanying drawings. Wherever possible, the same reference numbers are used in the drawings and the following description to refer to the same or similar elements. While embodiments and examples are described, modifications, adaptations, and other implementations are possible. For example, substitutions, additions, or modifications may be made to the elements and stages illustrated in the drawings, and the systems and methods described herein may be modified by substituting, reordering, or adding stages to the disclosed methods or elements to the discloses systems. Accordingly, the following detailed description does not limit the disclosure. Instead, the proper scope of any invention disclosed herein is defined by the appended claims.

A safe used in an SST, such as an ATM or a self-checkout terminal, may have two compartments. One of the compartments may house a currency dispenser, in addition to other SST components, and the other compartment may house currency cassettes. The currency dispenser may be a low value item with regard to thievery, while the currency cassettes may be a high value item with regard to thievery. In other words, the currency cassettes may contain the bulk of the currency housed within the safe.

During robbery attempts, thieves may try many different methods to access the currency cassettes. For example, thieves may try to simply pry the door of the safe open. Prying the door alone may not be effective because bolts within the door and hardened steel door frames make prying the door time consuming and may require a lot of tools.

Another method used to try to gain access to the currency cassettes may be to place a small explosive charge within the compartment of the SST having the currency dispenser. Thieves may first attack the current dispenser because the currency dispenser has a lot of moving parts and may be more difficult to fortify. The explosive charge may be large enough to cause a pressure buildup within the safe. The pressure buildup may cause the walls of the safe to bow outwards. The bowing may cause the bolts that secure the door to become less effective, thus allowing the door to be pried open with less effort, if not blown open by the explosive charge.

In an effort to minimize the destructive effects of an explosive charge, a safe may be segmented. The segmentation of the safe may allow the compartment with the currency cassettes to have increased fortification. The increased fortification may include additional bolts or pins that activate due to the explosion. For example, the explosion may cause a plate within the safe to move and thereby force additional locking bolts or pins into at least the door.

In addition, the safe may include a reinforcement member that helps stiffen the walls of the safe. The reinforcing member may act to mechanically link two or more exterior walls of the safe together. By linking the two or more exterior walls together, a greater explosive charge may be needed to access the currency cassettes. However, the explosive charge cannot be too great or the contents of the safe may be destroyed or otherwise rendered valueless.

FIG. 1 shows an example safe 100 consistent with embodiments disclosed herein. The safe 100 may include a body 102. The body 102 may include a first sidewall 104, a second sidewall 106, a top 108, a bottom 110, a rear sidewall 112, and a door 114. The door 114 may be attached to the second sidewall with hinges 116. In addition, the door may define an opening 118. The opening 118 may allow currency to be dispensed from a currency dispenser located within the safe.

Figure 2:
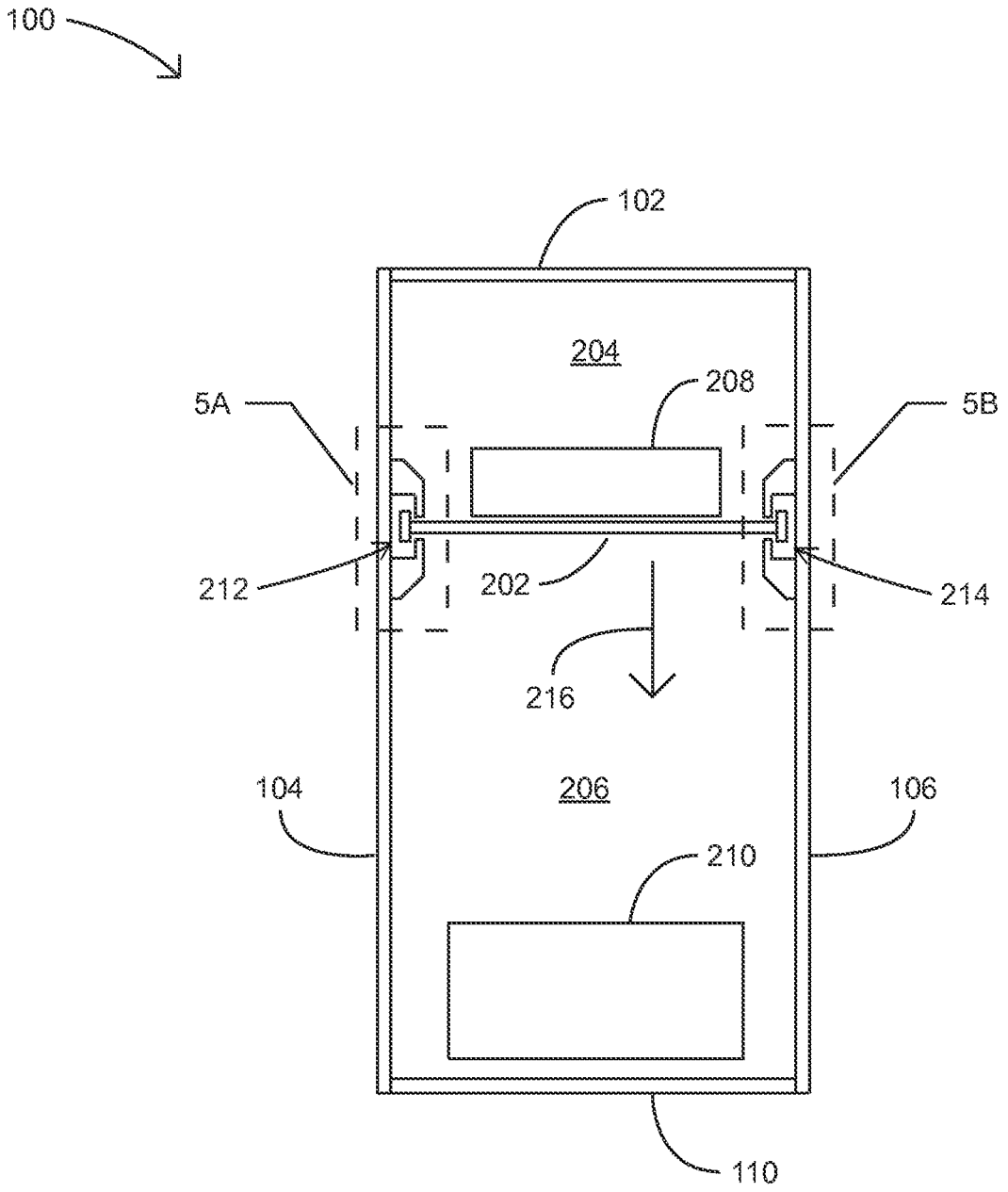
FIG. 2 shows an example cross-section of a safe consistent with embodiments disclosed herein.
Figure 3:
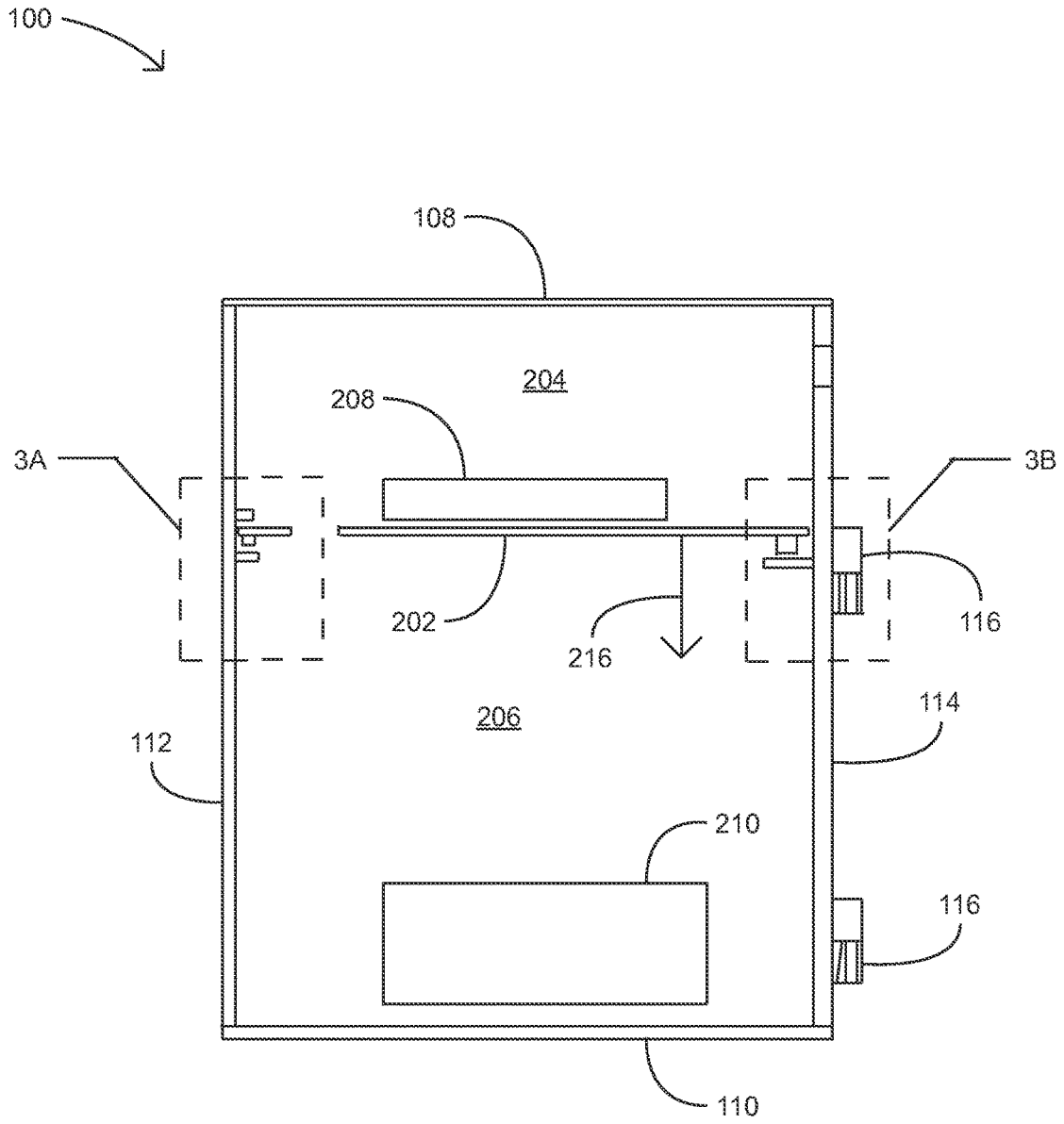
FIG. 3 shows an example cross-section of a safe consistent with embodiments disclosed herein.

FIGS. 2 and 3 each show a cross-section of the safe 100. As shown in FIGS. 2 and 3, the safe 100 may include a segmentation plate 202 that may be located within the internal volume defined by the body 102. The segmentation plate 202 may divide the internal volume into at least two compartments. For example, as shown in FIGS. 2 and 3, the internal volume may be divided into a first compartment 204 and a second compartment 206. The first compartment may house a currency dispenser 208 and the second compartment 206 may house at least one currency cassette 210.

The sidewalls 104, 106, 108, and 112, as well as the door 114, may include relief portions. For example, as shown in FIG. 1, the door 114 may include a door relief portion 120. The second sidewall 106 may include a side relief portion 122. While not shown in FIG. 1, first sidewall 104 may also include a relief portion. Consistent with embodiments, the safe 100 may include one or more of the relief portions.

The relief portions 120 and 122 may be a groove or other defect purposely placed in a material used to construct the door 114 or the sidewalls 104, 106, or 112. For example, the relief portions 120 and 122 may be a groove that extends into the material by a fixed amount (e.g., 3 mm) or a percentage of the thickness (e.g., 5%). The size, shape, and other configuration parameters of the relief portions 120 and 122 may be such that the relief portions 120 and 122 can allow the first compartment 204 to expand upon a pressure increase within the first compartment 204. For instance, an explosion within the first compartment 204 can cause the air and other gasses within the first compartment 204 to increase in temperature and expand rapidly. The rapid expansion can cause an increase in the pressure within the first compartment 204. Due to the relief portions 120 and 122 configurations, the first compartment 204 may expand. Stated another way, the explosion within the first compartment 204 may cause the sidewalls 104, 106, and the door 114 to deform and absorb some of the energy from the explosion.

Figure 4A:
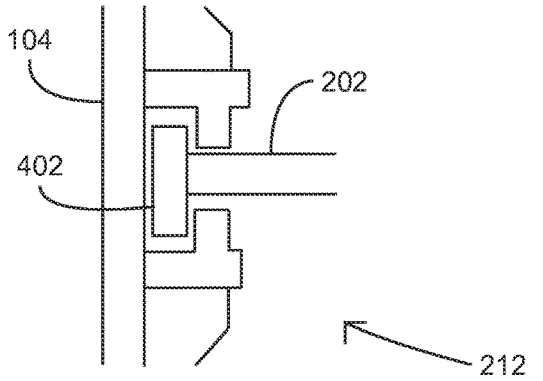
FIGS. 4A and 4B each show example side channels consistent with embodiments disclosed herein.
Figure 4B:
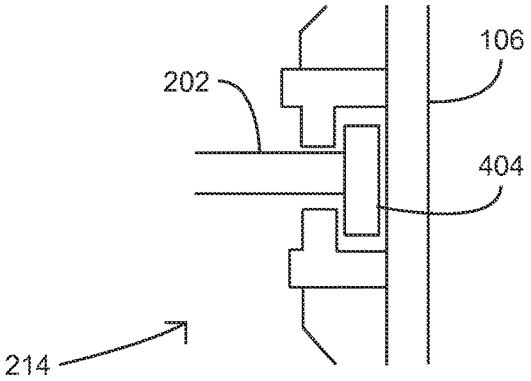

As shown in FIG. 2, the safe 100 may include a first side channel 212 and a second side channel 214. FIGS. 4A and 4B show first side channel 212 and second side channel 214, respectively. As shown in FIGS. 4A and 4B, the segmentation plate 202 may include a first vertical side rail 402 and a second vertical side rail 404.

The first vertical side rail 402 may move in both horizontal and vertical directions within the first side channel 212. The second vertical side rail 404 may move in both a horizontal and vertical directions with the second side channel 214. For example, during construction or maintenance of the safe 100, the segmentation plate 202 may be slid horizontally within the first side channel 212 and the second side channel 214 in order to install and remove the segmentation plate 202.

In addition, during an explosion within the first chamber 204, the segmentation plate 202 may slide in a downward direction as indicated by arrow 216. The downward movement of the segmentation plate 202 may allow the segmentation plate to absorb some of the energy released by the explosives.

Figure 5:
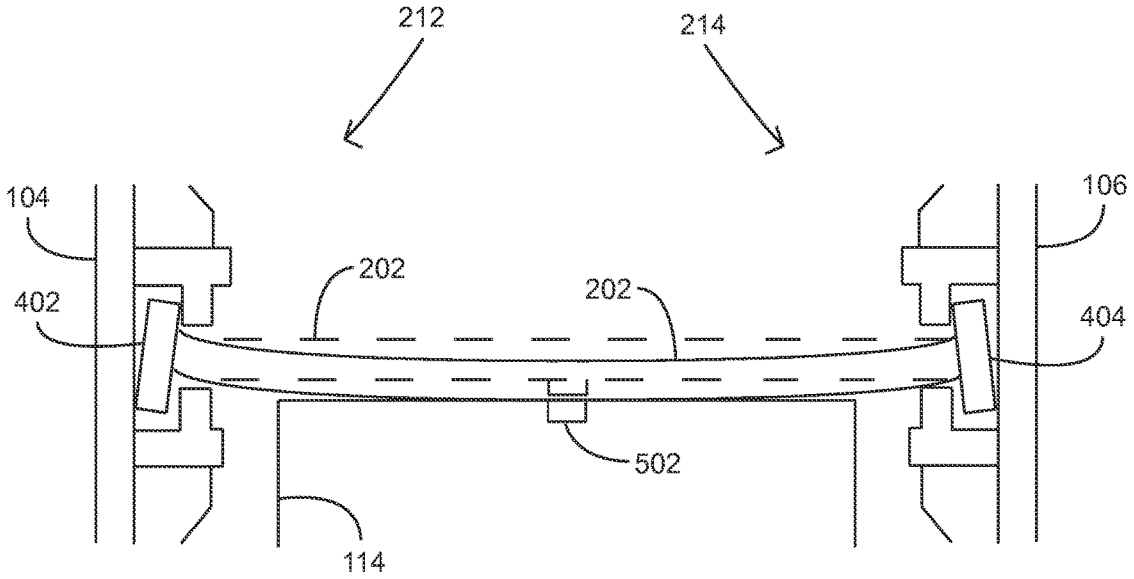
FIG. 5 shows an example segmentation plate in a first state and a second state consistent with embodiments disclosed herein.

In addition, as shown in FIG. 5, the pressure increased caused by an explosion may cause the segmentation plate 202 to deform. FIG. 5 shows the segmentation plate 202 in a first state (represented by dashed lines) and in a second state. As shown in FIG. 5, movement or deformation of the segmentation plate 202 may cause a pin 502 to travel in a downward direction and engage the door 114.

Figure 6:
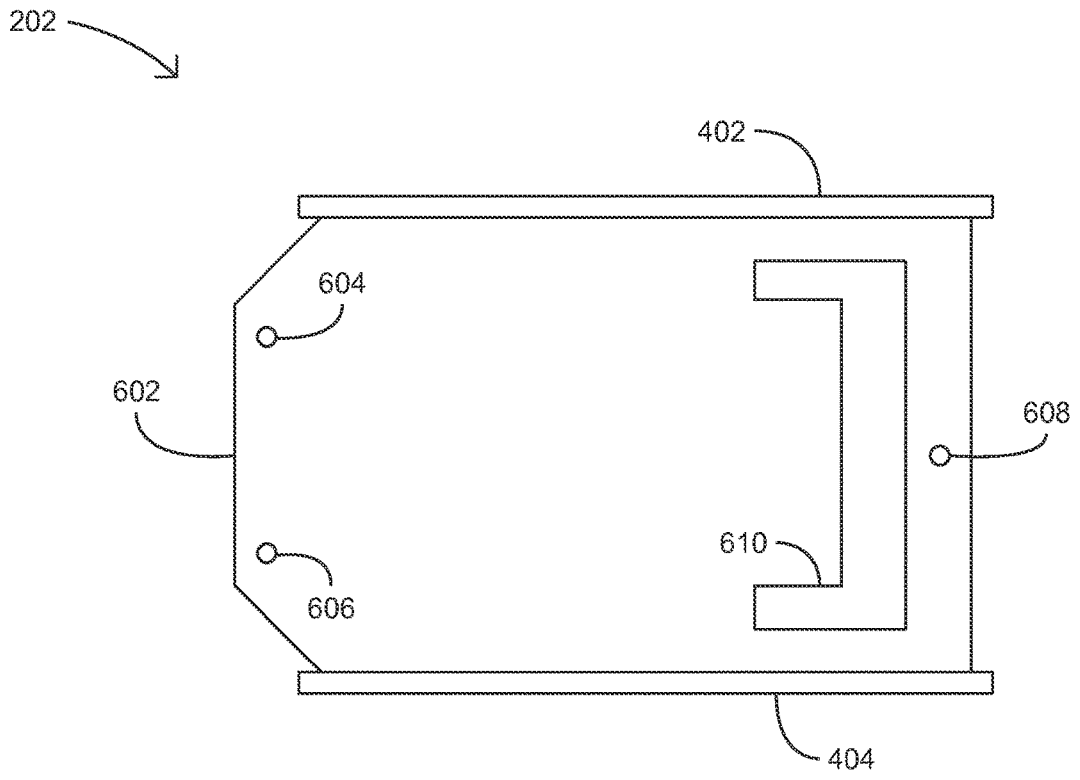
FIG. 6 shows an example segmentation plate consistent with embodiments disclosed herein.

FIG. 6 shows the segmentation plate 202. As shown in FIG. 6, the segmentation plate 202 may include the first vertical side rail 402 and the second vertical side rail 404. The first vertical side rail 402 and the second vertical side rail 404 may be connected by a planer member 602. Projecting from the planer member 602 may be a first door pin 604, a second door pin 606, and a rear pin 608. The pins 604, 606, and 608 may be located proximate various edges of the segmentation plate 202. For example, as shown in FIG. 3, a first edge of the segmentation plate 202 may be located proximate the door 114. The door pins 604 and 606 may located proximate the first edge. When the segmentation plate 202 is in a first state the door pins 604 and 606 may be located proximate holes, such as pin hole 702 shown in FIG. 7B. In the event of an explosion or other attack on the safe 100, the segmentation plate 202, or a portion thereof, may travel in a downward direction causing the door pins 604 and 606 to engage pin holes, such as pin hole 702. When door pins 604 and 606 engage pin holes, the door pins 604 and 606 may hinder movement of the door 114.

The segmentation plate 202 may further include a second edge that may be proximate the rear sidewall 112. The rear pin 608 may be located proximate the second edge. When the segmentation plate 202 is in the first state the rear pin 608 may be located proximate a hole, such as rear pin hole 704 shown in FIG. 7A. In the event of an explosion or other attack on the safe 100, the segmentation plate 202, or a portion thereof, may travel in a downward direction causing the rear pin 608 to engage a pin hole, such as the rear pin hole 704. When door pins 604 and 606 engage pin holes and the rear pin 608 engages the rear pin hole 704 the door 114 may be mechanically fastened to the rear sidewall 112, thus hindering movement of the door 114.

Figure 7A:
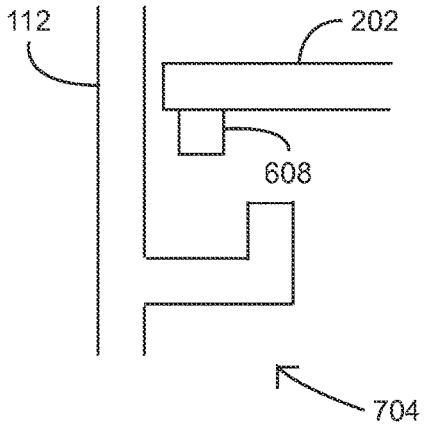
FIGS. 7A and 7B each show example rear and door pin, respectively, consistent with embodiments disclosed herein.
Figure 7B:
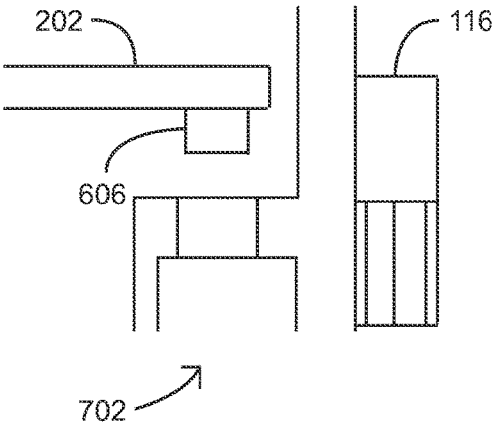

While FIGS. 6, 7A, and 7B show pins located proximate the rear sidewall 112 and the door 114, pins may be located along side edges of the segmentation plate 202. The pins may be proximate sidewall pin holes defined by a portion of the first side rail 212 or the second side rail 214 when the segmentation plate 202 is in a first state. When the segmentation plate 202 is in a second state, the pins may engage the sidewall pin holes and hinder movement of the door 114 and the segmentation plate 202.

In addition, the segmentation plate 202 may include an opening 610. The opening 610 may be large enough to allow for pressure equalization upon a pressure increase within the second compartment 206. In addition, the opening 610 may be small enough to prevent a human hand from passing through the opening 610. Stated another way, if the first compartment 204 is breached and an explosive is placed inside the second compartment 206, when the explosion is detonated, the opening 610 may be large enough to allow the energy and expanding gasses to vent from the second compartment 206 without causing such damage to the first chamber 206 that the contents of the second compartment 206 cannot be easily accessed.

While FIG. 6 shows the segmentation plate 202 having one hole 610, the segmentation plate 202 may have multiple holes. The holes may be dispersed through planer member 602. The spacing of the holes may allow smaller holes to be utilized while still allowing energy and expanding gasses to escape the second compartment 206 in the event of an explosion within the second compartment 206.

Consistent with embodiments disclosed herein the safe 100 may include the body 102 and the body 102 may include the first side wall 106, the second sidewall 104, the top 108, the bottom 110, the rear sidewall 112, and a door 114 that may define an interior volume. The door 114 may be connected to the second sidewall 106 by hinges 116. The segmentation plate 202 may be located within the interior volume and may divide the interior volume into the first compartment 204 and the second compartment 206. The segmentation plate 202 may include a door pin, such as door pin 604 or 606, that may be located proximate a first edge of the segmentation plate 202. The first edge may be proximate the door 114.

When the segmentation plate 202 is in a first state the door pin 604 or 606 may be proximate a door pin hole 702 that may be defined by a portion of the door 114. When the segmentation plate 202 is in a second state the door pin 604 or 606 may engage the door pin hole 702 and hinders movement of the door 114.

The segmentation plate 202 may be vertically slideable from a first position when in the first state to a second position when in the second state. The first state may be an undeformed state and the second state may be a deformed state. The deformed state may be caused by a pressure increase within the first compartment 204.

The segmentation plate 202 may further include the first side rail 402 that may be located in the first side channel 212 that may be attached to the first sidewall 104. The segmentation plate 202 may further include the second side rail 404 that may be located in the second side channel 214 that may be attached to the second sidewall 106. The segmentation plate 202 may be slideable within the first side channel 212 and the second side channel 214 from the first state to the second state.

The first sidewall 104 or the second sidewall 106 may include a side relief portion 122 that may be located on an exterior surface of the first compartment 204. The side relief portion 122 may be configured to cause the first compartment 204 to expand upon a pressure increase within the first compartment 204.

The first sidewall 104 and the second sidewall 106 each may include a side relief portion 122 located on an exterior surface of the first compartment 204. The side relief portions may be configured to cause the first compartment 204 to expand upon a pressure increase within the first compartment 204.

The door 114 may include a relief portion 120 that may be located on an exterior surface of the first compartment 204. The relief portion 120 may be configured to cause the first compartment 204 to expand upon a pressure increase within the first compartment 204.

The segmentation plate 202 may define an opening 610 that may be large enough to allow for pressure equalization upon a pressure increase within the second compartment 206 and small enough to prevent a human hand from passing though the opening 610.

The segmentation plate 202 may further comprise a second edge proximate the rear sidewall 112 and the rear pin 608 may be located proximate the second edge. When the segmentation plate 202 is in the first state the rear pin 608 may be proximate the rear pin hole 704 that may be defined by a portion of the rear sidewall 112. When the segmentation plate 202 is in the second state the rear pin 608 may engage the rear pin hole 704 and may hinder movement of the door 114 and the segmentation plate 202.

The segmentation plate 202 may further comprise a second edge proximate the first side rail 402 or the second side rail 404. A sidewall pin may be located proximate the second edge. When the segmentation plate 202 is in the first state the sidewall pin may be proximate a sidewall pin hole defined by a portion of the first sidewall 104 or the second sidewall 106. When the segmentation plate 202 is in the second state the sidewall pin may engage the sidewall pin hole and may hinder movement of the door 114 and the segmentation plate 202.

Figure 8:
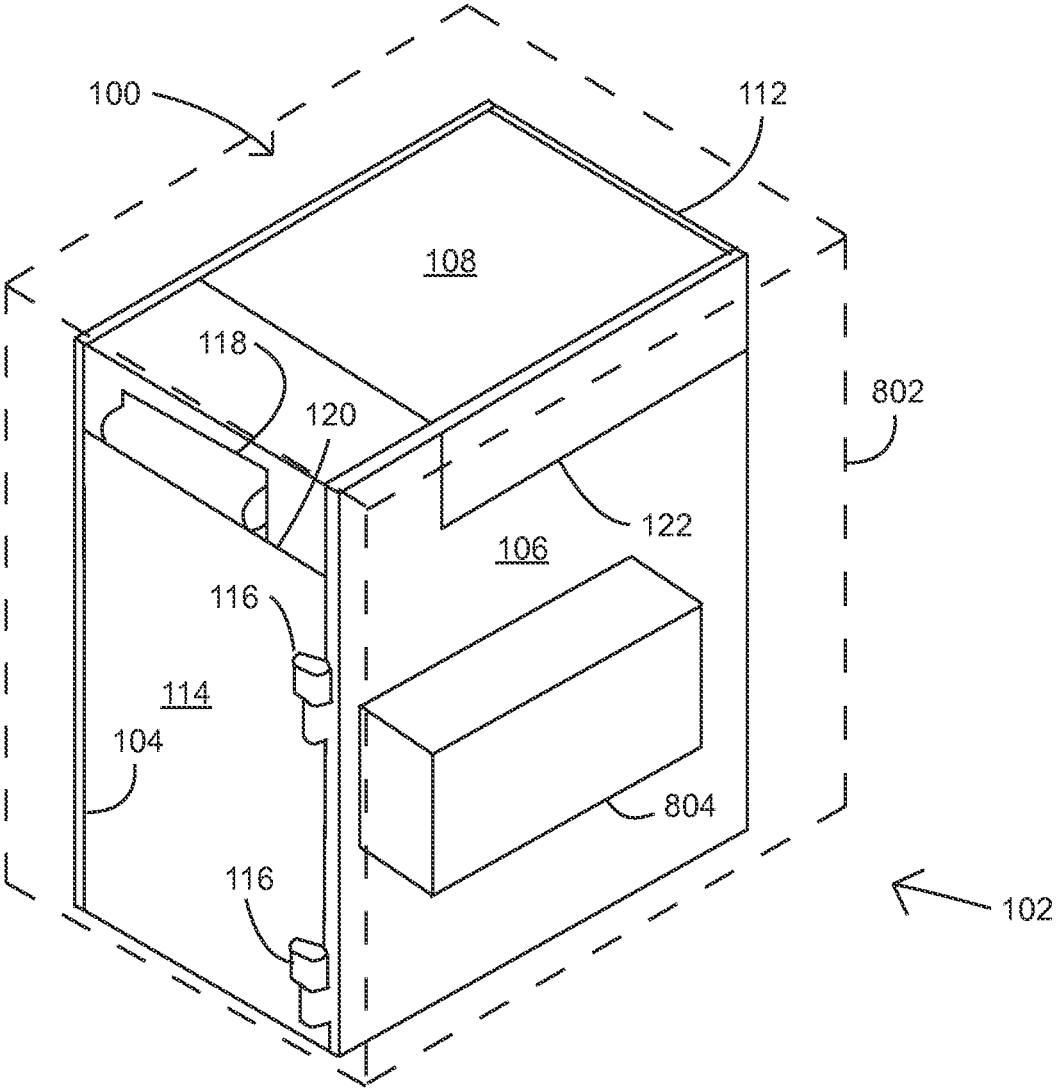
FIG. 8 shows an example self-service terminal consistent with embodiments disclosed herein.

FIG. 8 shows a self-service terminal 802. The self-service terminal may include a safe 100 and a valuable media dispenser 804. The safe 100 may comprise a body 102 that may include a first sidewall 104, a second sidewall 106, a top 108, a bottom 110, a rear sidewall 112 and a door 114 that may define an interior volume. The door 114 may be connected to the second sidewall 106 with hinges 116. The first side channel 212 may be attached to the first sidewall 104 and the second side channel 214 may be attached to the second sidewall 106. The segmentation plate 202 may be located within the interior volume and may divide the interior volume into the first compartment 204 and the second compartment 206. The segmentation plate 202 may include the door pin that may be located proximate a first edge of the segmentation plate 202. The rear pin may be located proximate a second edge of the segmentation plate 202. The first vertical side rail 402 may be slideably located in the first side channel 212 and the second vertical side rail 404 may be slideably located in the second side channel 214.

The valuable media dispenser 804 may include a presenter portion (such as the currency dispenser portion 208) and a pick unit (such as currency cassette 210). The valuable media dispenser 804 may be located within the first compartment 204 above the segmentation plate 202 (not shown in FIG. 8) and the pick unit may be located within the second compartment 206 below the segmentation plate 202. The pick unit may be in communication with the presenter portion via a hole in the segmentation plate 202.

Another embodiment provides a self-service terminal (such as an automated teller machine) comprising: a safe including: a body defining an interior volume; and a segmentation plate located within the interior volume and dividing the interior volume into a first compartment and a second compartment, the segmentation plate being movably mounted within the interior volume to deflect in response to increased pressure in either the first or second compartment; and a valuable media dispenser (such as a cash dispenser or a cash recycler) including a presenter portion located within the first compartment above the segmentation plate, a pick unit located within the second compartment below the segmentation plate, and a media transport extending from the pick unit through an aperture in the segmentation plate to the presenter portion.

Yet another embodiment provides a secure enclosure, such as a safe, comprising: a body including a first sidewall, a second sidewall, a top, a bottom, a rear sidewall and a door defining an interior volume, the door hingably connected to the second sidewall; a first side channel attached to the first sidewall; a second side channel attached to the second sidewall; and a segmentation plate movably mounted within the interior volume and dividing the interior volume into a first compartment and a second compartment, the segmentation plate being configured to deflect in response to increased pressure in either the first or second compartment.

In such embodiments, the segmentation plate optionally includes projections (such as pins) extending therefrom and located opposite complementary formations (such as apertures) in the body (such as sidewalls or the door) so that when the segmentation plate deflects in response to increased pressure the projections engage with the complementary formations and thereby increase the structural rigidity of the body, for example to resist the door being blown open in response to an explosion within the interior volume.

The body optionally defines a first sidewall, a second sidewall, and a door hingably coupled to the first or second sidewall and closing an aperture defined by the first and second sidewall when the door is in a closed position, and wherein the first sidewall or the second sidewall includes a side relief portion located on an exterior surface of the first compartment, the side relief portion being configured to cause the first compartment to expand upon a pressure increase within the first compartment.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A safe comprising:

a body defining an interior volume;

a segmentation plate movably mounted within the interior volume and dividing the interior volume into a first compartment and a second compartment, the segmentation plate being configured to deflect in response to increased pressure in either the first or second compartment, wherein the segmentation plate includes projections extending therefrom and located opposite complementary formations in the body so that when the segmentation plate deflects in response to increased pressure the projections engage with the complementary formations and thereby increase the structural rigidity of the body, wherein the body defines a first sidewall, a second sidewall, and a door hingably coupled to the first or second sidewall and closing an aperture defined by the first and second sidewall when the door is in a closed position, and wherein the first sidewall or the second sidewall includes a side relief portion located on an exterior surface of the first compartment, the side relief portion configured to cause the first compartment to expand upon a pressure increase within the first compartment, wherein the segmentation plate further comprises:

a first edge located proximate the door; and a door pin located proximate the first edge, wherein when the segmentation plate is in a first state the door pin is proximate a door pin hole defined by a portion of the door, wherein when the segmentation plate is in a second state the door pin engages the door pin hole and hinders movement of the door.

2. The safe of claim 1, wherein the first sidewall and the second sidewall each include a side relief portion located on an exterior surface of the first compartment, the side relief portions configured to cause the first compartment to expand upon a pressure increase within the first compartment.

3. The safe of claim 1, wherein the door includes a relief portion located on an exterior surface of the first compartment, the relief portion configured to cause the first compartment to expand upon a pressure increase within the first compartment.

4. The safe of claim 1, wherein the segmentation plate defines an opening large enough to allow for pressure equalization upon a pressure increase within the second compartment and small enough to prevent a human hand from passing though the opening.

5. The safe of claim 1, wherein the segmentation plate further comprises:

a second edge proximate a rear sidewall; and a rear pin located proximate the second edge, wherein when the segmentation plate is in the first state the rear pin is proximate a rear pin hole defined by a portion of the rear sidewall, wherein when the segmentation plate is in the second state the rear pin engages the rear pin hole and hinders movement of the door and the segmentation plate.

6. The safe of claim 1, wherein the safe further comprises:

a first side channel attached to the first sidewall;

a second side channel attached to the second sidewall; and the segmentation plate further comprises:

a first vertical side rail slideably located in the first side channel and a second vertical side rail slideably located in the second side channel;

a second edge proximate the first side rail or the second side rail; and a sidewall pin located proximate the second edge, wherein when the segmentation plate is in the first state the sidewall pin is proximate a sidewall pin hole defined by a portion of the first side rail or the second side rail, wherein when the segmentation plate is in the second state the sidewall pin engages the sidewall pin hole and hinders movement of the door and the segmentation plate.

7. A safe comprising:

a body including a first sidewall, a second sidewall, a top, a bottom, a rear sidewall and a door defining an interior volume, the door hingably connected to the second sidewall; and a segmentation plate located within the interior volume and dividing the interior volume into a first compartment and a second compartment, the segmentation plate including a door pin located proximate a first edge of the segmentation plate, the first edge proximate the door, wherein when the segmentation plate is in a first state, the door pin is proximate a door pin hole defined by a portion of the door, wherein when the segmentation plate is in the second state, the door pin engages the door pin hole and hinders movement of the door.

8. The safe of claim 7, wherein the segmentation plate is vertically slideable from a first position when in the first state to a second position when in the second state.

9. The safe of claim 7, wherein the first state is an undeformed state and wherein the second state is a deformed state caused by a pressure increase within the first compartment.

10. The safe of claim 7 wherein the segmentation plate further includes a first side rail located in a first side channel attached to the first sidewall and a second side rail located in a second side channel attached to the second sidewall, the segmentation plate slideable within the first side channel and the second side channel from the first state to the second state.

11. The safe of claim 7, wherein the first sidewall or the second sidewall includes a side relief portion located on an exterior surface of the first compartment, the side relief portion configured to cause the first compartment to expand upon a pressure increase within the first compartment.

12. The safe of claim 7, wherein the first sidewall and the second sidewall each include a side relief portion located on an exterior surface of the first compartment, the side relief portions configured to cause the first compartment to expand upon a pressure increase within the first compartment.

13. The safe of claim 7, wherein the door includes a relief portion located on an exterior surface of the first compartment, the relief portion configured to cause the first compartment to expand upon a pressure increase within the first compartment.

14. The safe of claim 7, wherein the segmentation plate defining an opening large enough to allow for pressure equalization upon a pressure increase within the second compartment and small enough to prevent a human hand from passing though the opening.

15. The safe of claim 7, wherein the segmentation plate further comprises:

a second edge proximate the rear sidewall; and a rear pin located proximate the second edge, wherein when the segmentation plate is in the first state the rear pin is proximate a rear pin hole defined by a portion of the rear sidewall, wherein when the segmentation plate is in the second state the rear pin engages the rear pin hole and hinders movement of the door and the segmentation plate.

16. The safe of claim 7, wherein the segmentation plate further comprises:

a second edge proximate a first side rail or a second side rail; and a sidewall pin located proximate the second edge, wherein when the segmentation plate is in the first state the sidewall pin is proximate a sidewall pin hole defined by a portion of the first sidewall or the second sidewall, wherein when the segmentation plate is in the second state the sidewall pin engages the sidewall pin hole and hinders movement of the door and the segmentation plate.

17. A self-service terminal comprising:

a safe including:

a body defining an interior volume; and a segmentation plate located within the interior volume and dividing the interior volume into a first compartment and a second compartment, the segmentation plate being movably mounted within the interior volume to deflect in response to increased pressure in either the first or second compartment, wherein the segmentation plate includes projections extending therefrom and located opposite complementary formations in the body so that when the segmentation plate deflects in response to increased pressure the projections engage with the complementary formations and thereby increase the structural rigidity of the body, wherein the body defines a first sidewall, a second sidewall, and a door hingably coupled to the first or second sidewall and closing an aperture defined by the first and second sidewall when the door is in a closed position, and wherein the first sidewall or the second sidewall includes a side relief portion located on an exterior surface of the first compartment, the side relief portion configured to cause the first compartment to expand upon a pressure increase within the first compartment, wherein the segmentation plate further comprises:

a first edge located proximate the door; and a door pin located proximate the first edge, wherein when the segmentation plate is in a first state the door pin is proximate a door pin hole defined by a portion of the door, wherein when the segmentation plate is in a second state the door pin engages the door pin hole and hinders movement of the door; and a valuable media dispenser including a presenter portion located within the first compartment above the segmentation plate, a pick unit located within the second compartment below the segmentation plate, and a media transport extending from the pick unit through an aperture in the segmentation plate to the presenter portion.

* * * * *